US006936782B2

(12) United States Patent
Ito

(10) Patent No.: US 6,936,782 B2
(45) Date of Patent: Aug. 30, 2005

(54) KEYBOARD SWITCH MECHANISM

(75) Inventor: Hideki Ito, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 91 days.

(21) Appl. No.: 10/780,997

(22) Filed: Feb. 18, 2004

(65) Prior Publication Data

US 2004/0163937 A1 Aug. 26, 2004

(30) Foreign Application Priority Data

Feb. 24, 2003 (JP) ..... 2003-046462

(51) Int. Cl.[7] ..... H01H 13/70

(52) U.S. Cl. ..... 200/344; 200/341; 200/345; 200/5 R

(58) Field of Search ..... 200/344, 341, 200/345, 329, 5 A, 5 R

(56) References Cited

U.S. PATENT DOCUMENTS 5,813,521 A * 9/1998 Koike et al. ..... 200/344
6,060,676 A * 5/2000 Pan ..... 200/344
6,066,818 A * 5/2000 Pan ..... 200/304
6,118,092 A * 9/2000 Hayashi ..... 200/344

FOREIGN PATENT DOCUMENTS

JP 11-16440 1/1999

* cited by examiner

*Primary Examiner*—K. Lee
(74) *Attorney, Agent, or Firm*—Brinks Hofer Gilson & Lione

(57) ABSTRACT

The present invention provides a keyboard switch which can reduce the number of assembly processes by decreasing the number of components and which can be easily assembled. First to third link members 5, 6 and 7 of a keyboard switch of the present invention include one end portions 5*a*, 6*a* and 7*a* and the other end portions 5*g*, 6*g* and 7*g*, which face each other. The first to third link members 5, 6 and 7 are installed so as not to cross each other, and have their one end portions 5*a*, 6*a* and 7*a* slidably supported by first to third slide supporting portions 3*a*, 3*b* and 4*a* formed on a key top, and their other end portions 5*g*, 6*g* and 7*g* rotatably supported by first to third rotating supporting portions 10*a*, 10*b* and 10*c* formed on a base plate 10.

6 Claims, 8 Drawing Sheets

KEYBOARD SWITCH MECHANISM

This application claims the benefit of priority to Japanese Patent Application No. 2003-046462, herein incorporated by reference.

BACKGROUND OF THE INVENTION

1. Field of the Invention

The present invention relates to a keyboard switch, and more particularly to a keyboard switch for supporting a key top with a plurality of link members.

2. Description of the Related Art

A conventional keyboard switch will now be explained with reference to FIG. 15. The conventional keyboard switch 21 includes a base frame 22 on the lower side, and a key top 23 on the upper side facing the base frame 22.

A membrane switch 24 formed by stacking three layers of film sheets is installed on the lower side of the base frame 22 and is inserted between a metal panel 25 and the base frame 22.

In addition, a circular hole 26 is formed on the base frame 22, slide guides 27 and 28 lifted from the base frame 22 and extended to the outside in parallel to the base frame 22 are formed around the circular hole 26, and lower rotating shafts 33*b*, 33*b* of a pair of link members 33, 33 are slidably supported by the slide guides 27 and 28.

In addition, split type bearings 30 and 31 for rotatably supporting upper rotating shafts 33*a*, 33*a* of the link members 33, 33 are formed on the back surface of the key top 23.

Pedestals 35 and 36 protrude from the base frame 22 outside the slide guides 27 and 28, respectively.

Before assembling the key top 23, when the lower rotating shafts 33*b*, 33*b* of the link members 33, 33 are inserted into the slide guides 27 and 28 in the level state, the upper rotating shafts 33*a* thereof are position-determined on the pedestals 35 and 36, respectively.

In addition, an elastic member 39 having a dome-shaped inside is mounted on the circular hole 26 of the base frame 22, and an upper end portion 39*a* of the elastic member 39 is position-determined on a position determining portion 23*a* of the key top 23.

In the assembly process of the conventional keyboard switch 21 as described above, the membrane switch 24 is inserted between the base frame 22 and the metal panel 25, and then the elastic member 39 is adhered to the circular hole 26 of the base frame 22 using an adhesive.

Then, the lower rotating shafts 33*b*, 33*b* of the link members 33, 33 are inserted into the slide guides 27 and 28 of the base frame 22, and the upper rotating shafts 33*a*, 33*a* thereof are positioned on the pedestals 35 and 36, so that the link members 33, 33 can be position-determined in parallel to the base frame 22.

When the upper rotating shafts 33*a*, 33*a* of the link members 33, 33 are position-determined on the pedestals 35 and 36 formed on the base frame 22, the position determining portion 23*a* of the key top 23 is positioned on the position determining portion 39*a* of the elastic member 39 in the upper portions of the link members 33, 33, and the key top 23 is pressed downward. Therefore, the upper rotating shafts 33*a* of the link members 33 position-determined on the pedestals 35 and 36 are inserted into the split type bearings 30 and 31.

And then, when pressure applied to the key top 23 is removed, the key top 23 is lifted to a predetermined position by an elastic force of the elastic member 39, and the lower rotating shafts 33*b*, 33*b* of the link members 33, 33 slide into the slide guides 27 and 28 to lift the upper rotating shafts 33*a*, 33*a*.

[Patent Document 1]

Japanese Unexamined Patent Application Publication No. 11-16440

However, the conventional keyboard switch 21 requires the pedestals 35 and 36 that are members for determining the positions of the link members 33, 33 and thus uses the base frame 22, thereby increasing the number of components.

In addition, in an assembly process, the upper rotating shafts 33*a*, 33*a* of the link members 33, 33 must be position-determined on the pedestals 35 and 36 formed on the base frame 22, thereby increasing the number of assembly processes.

SUMMARY OF THE INVENTION

The present invention is contrived to solve the above problems. An object of the present invention is to provide a keyboard switch which can reduce the number of components by removing a base frame and which can be easily assembled by decreasing the number of assembly processes.

As a first means for solving the problems, a keyboard switch according to the present invention includes a key top, a base plate installed on the side facing the key top, an insulation film sheet mounted thereon, an elastic member for applying elasticity to the key top at a predetermined height from the base plate, a plurality of link members for supporting the key top to be freely lifted to or lowered from the base plate, and a contact point portion opened or closed by the lifting or lowering operation of the key top, wherein each of the plurality of link members has one end portion and the other end portion facing each other, the plurality of link members being installed so as not to cross each other with their one end portions slidably supported by slide supporting portions formed on the key top and their other end portions rotatably supported by rotating supporting portions formed on the base plate.

As a second means for solving the problems, each of the plurality of link members has one side portion and the other side portion in orthogonal direction to the one end portion and the other end portion so that the one side portion and the other side portion face each other, first shaft portions protrude to the outside from the one side portion and the other side portion of the one end portion, second shaft portions protrude in the same directions as the first shaft portions from the one side portion and the other side portion of the other end portion, the first shaft portions are slidably supported by the slide supporting portions of the key top, and the second shaft portions are rotatably supported by the rotating supporting portions of the base plate.

As a third means for solving the problems, the plurality of link members includes first, second and third link members, the first and second link members are installed to face each other with the elastic member between them, and the third link member is positioned outside the first and second shaft portions with the first and second shaft portions installed in orthogonal direction to the protrusion directions of the first and second shaft portions of the first and second link members.

As a fourth means for solving the problems, the elastic member applies elasticity to the center portion of the key top, and the first shaft portions of the link members supported by the slide supporting portions of the key top are aligned more closely to the elastic member than the second shaft portions thereof.

As a fifth means for solving the problems, three sets of slide supporting portions are formed to face each other, the first and second slide supporting portions for supporting the first shaft portions of the first and second link members are adjacent to the first supporting walls formed on the key top, and when the key top reaches a predetermined lifting position, the movement of the first shaft portions of the first and second link members is restricted in the first and second slide supporting portions to prevent the key top from being lifted over the predetermined lifting position.

As a sixth means for solving the problems, the third slide supporting portions for supporting the first shaft portions of the third link member are installed on the second supporting walls formed on the key top. The third link member has its other end portions protrude more to the outside than the second shaft portions, and, when the key top reaches the lifting position, the other end portion contacts the base plate, on which the film sheet is mounted, to prevent the key top from being lifted over the lifting position.

As a seventh means for solving the problems, front end portions of each of the first shaft portions of the link members are tapered.

DESCRIPTION OF THE PREFERRED EMBODIMENTS

The present invention relates to a keyboard apparatus used for an I/O mechanism such as a personal computer or a keyboard switch suitable for an input switch apparatus. The keyboard apparatus according to the present invention will now be described with reference to FIGS. 1 to 14.

Figure 1:
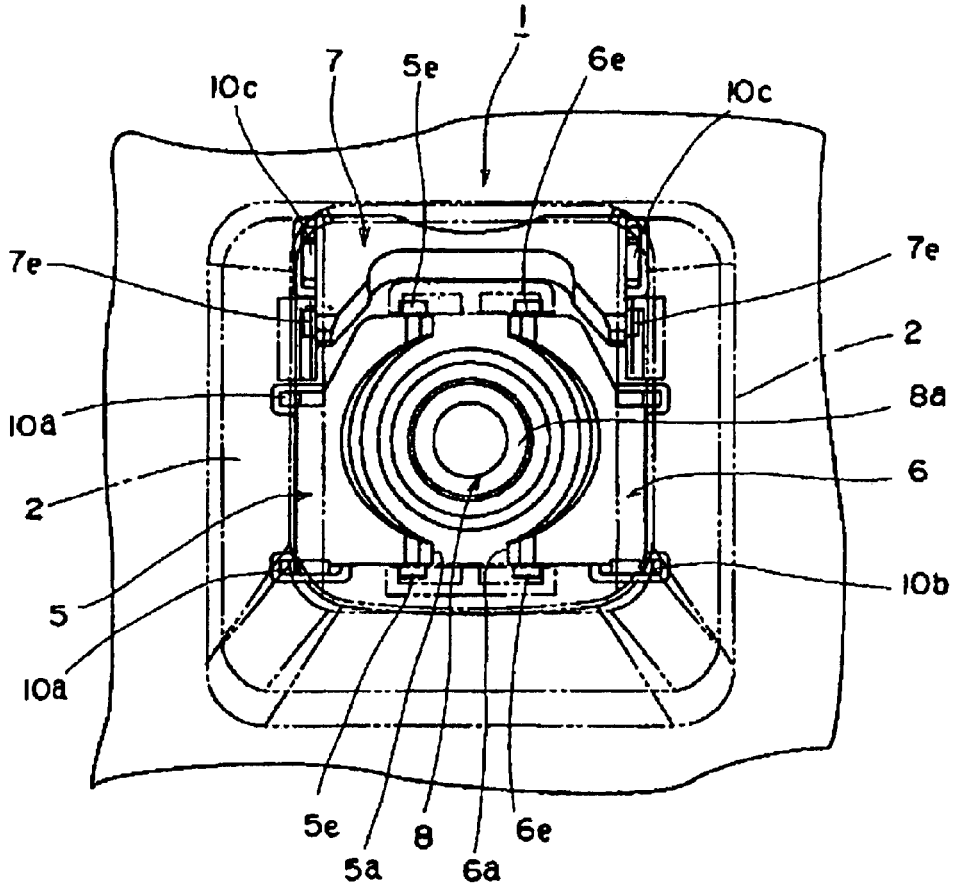
FIG. 1 is a plan view illustrating a keyboard switch according to the present invention.
Figure 2:
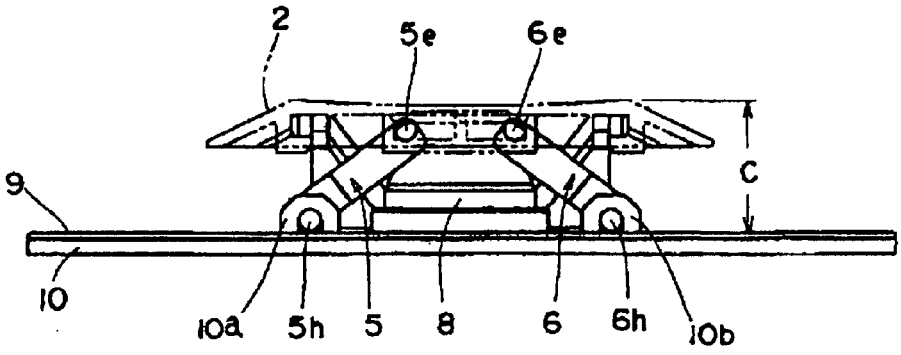
FIG. 2 is a front view illustrating the keyboard switch according to the present invention.
Figure 3:
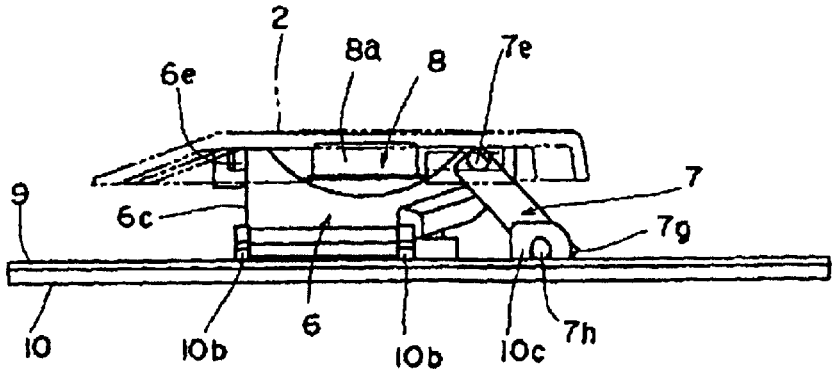
FIG. 3 is a right side view illustrating the keyboard switch according to the present invention.
Figure 4:
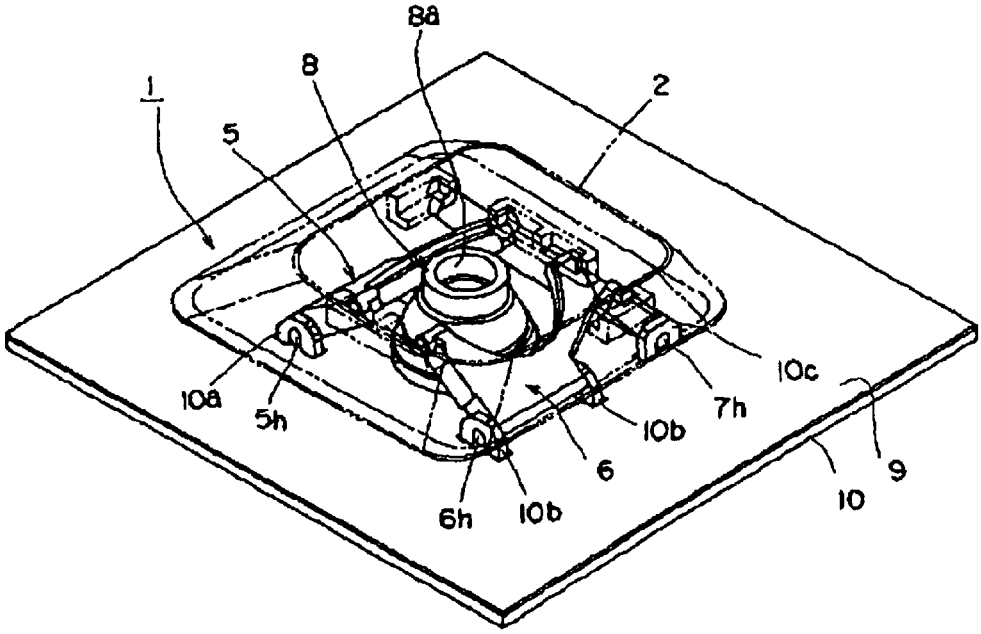
FIG. 4 is a perspective view illustrating the keyboard switch according to the present invention.
Figure 5:
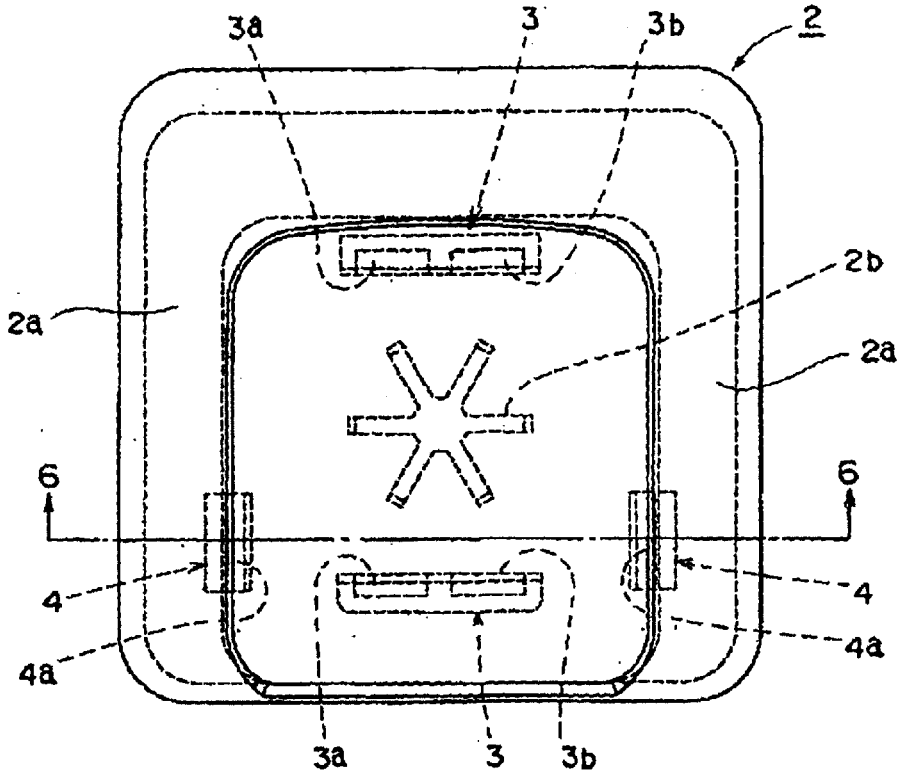
FIG. 5 is a top view illustrating a key top according to the present invention.
Figure 6:
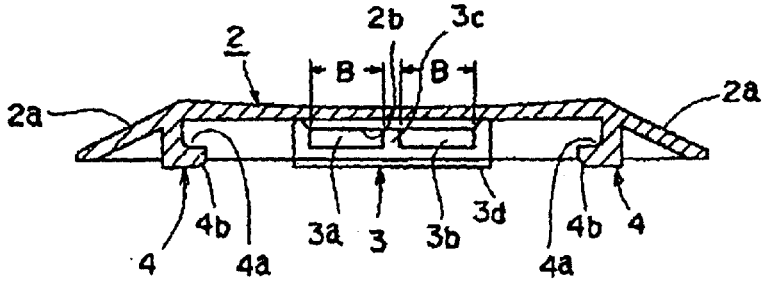
FIG. 6 is a cross-sectional view illustrating major portions of the key top according to the present invention.
Figure 7:
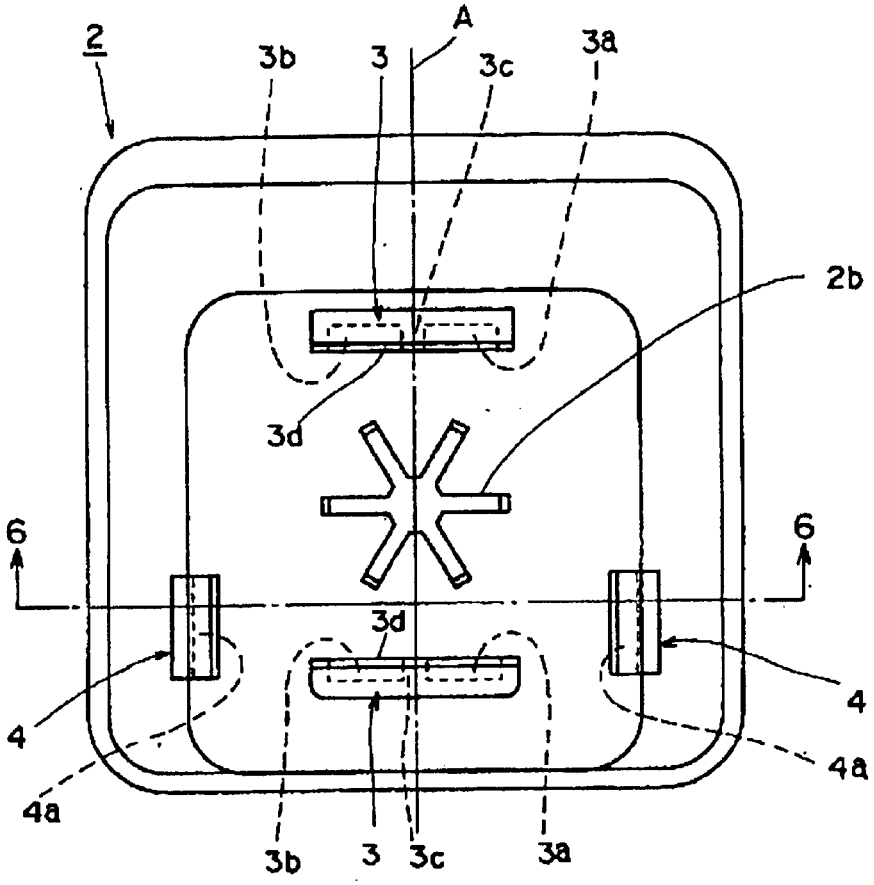
FIG. 7 is a bottom view illustrating the key top according to the present invention.
Figure 8:
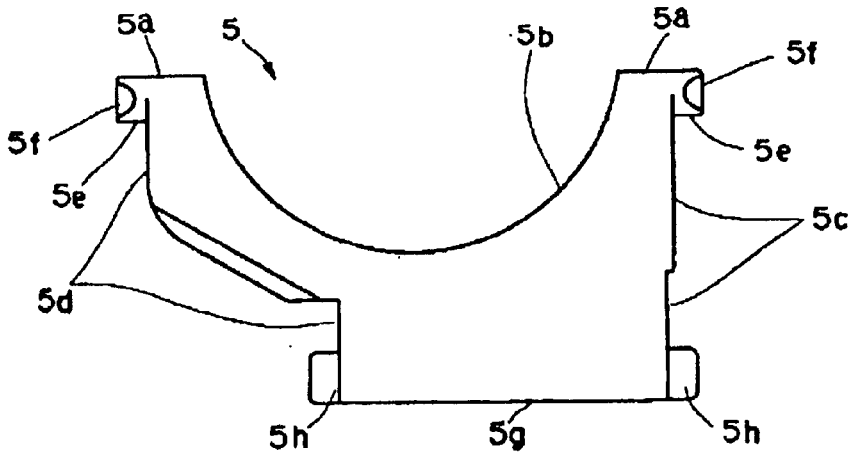
FIG. 8 is a plan view illustrating a first link member according to the present invention.
Figure 9:
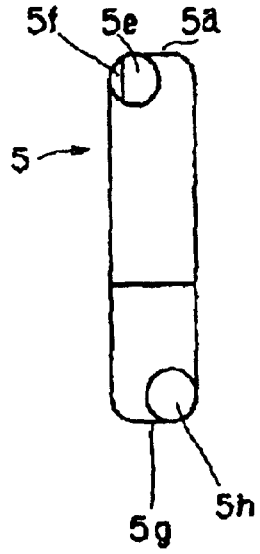
FIG. 9 is a side view illustrating the first link member according to the present invention.
Figure 10:
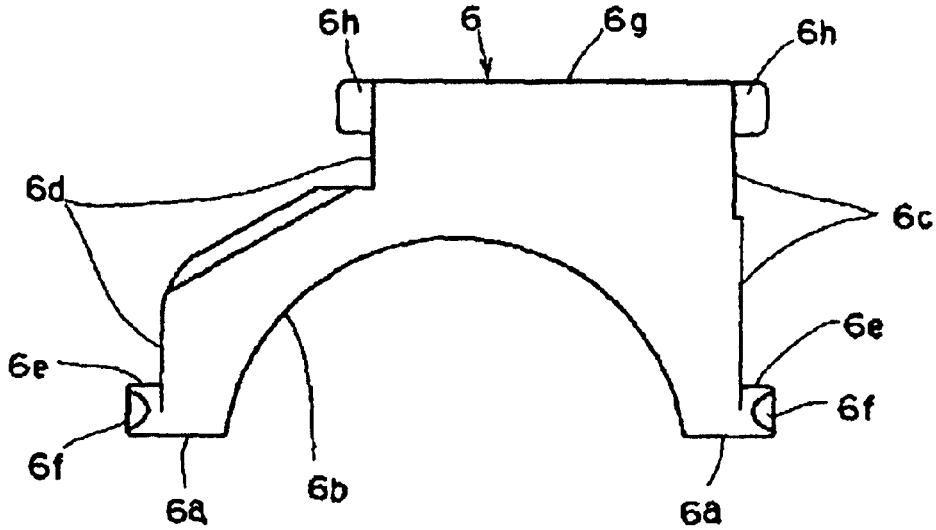
FIG. 10 is a plan view illustrating a second link member according to the present invention.
Figure 11:
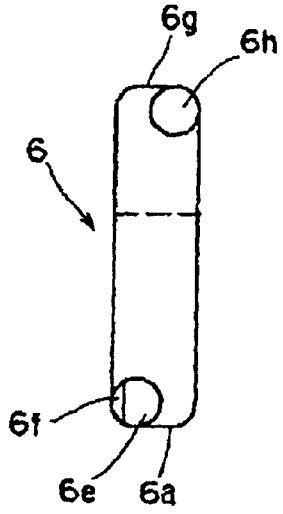
FIG. 11 is a side view illustrating the second link member according to the present invention.
Figure 12:
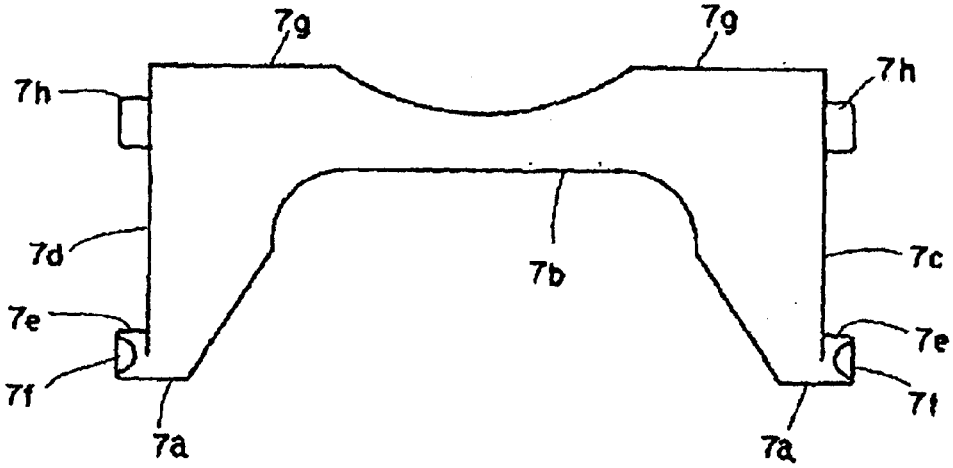
FIG. 12 is a plan view illustrating a third link member according to the present invention.
Figure 13:
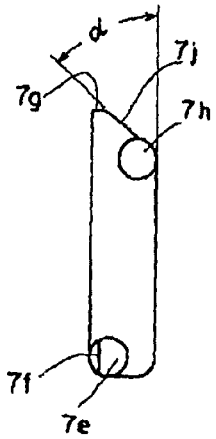
FIG. 13 is a side view illustrating the third link member according to the present invention.
Figure 14:
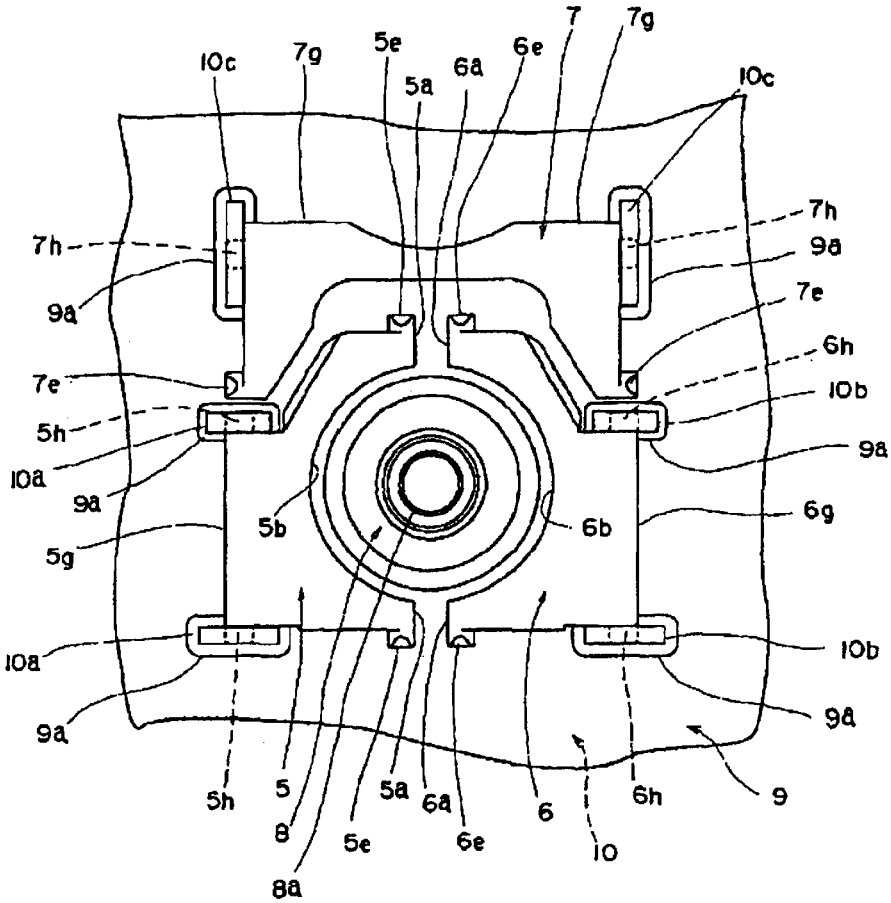
FIG. 14 is a view illustrating position relations of the link members according to the present invention.
Figure 15:
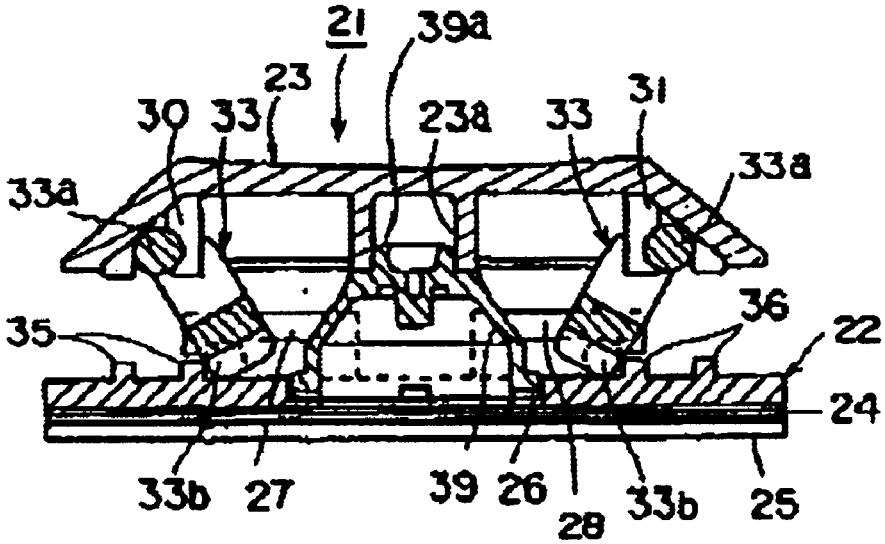
FIG. 15 PRIOR ART
FIG. 15 is a cross-sectional view illustrating major parts of a conventional keyboard switch.

FIG. 1 is a plan view illustrating a keyboard switch according to the present invention. FIG. 2 is a front view illustrating the keyboard switch according to the present invention. FIG. 3 is a right side view illustrating the keyboard switch according to the present invention. FIG. 4 is a perspective view illustrating the keyboard switch according to the present invention. FIG. 5 is a top view illustrating a key top according to the present invention. FIG. 6 is a cross-sectional view illustrating major portions of the key top according to the present invention. FIG. 7 is a bottom view illustrating the key top according to the present invention. FIG. 8 is a plan view illustrating a first link member according to the present invention. FIG. 9 is a side view illustrating the first link member according to the present invention. FIG. 10 is a plan view illustrating a second link member according to the present invention. FIG. 11 is a side view illustrating the second link member according to the present invention. FIG. 12 is a plan view illustrating a third link member according to the present invention. FIG. 13 is a side view illustrating the third link member according to the present invention. FIG. 14 is a view illustrating position relations of the link members according to the present invention.

As illustrated in FIGS. 1 to 4, a key top 2 is installed in the uppermost portion of the keyboard switch 1 according to the present invention. The key top 2 is made of resin. As shown in FIGS. 5 to 7, the outer appearance of the key top 2 is rectangular, and as shown in FIG. 6, the outer circumferential portion of the key top 2 is surrounded by a smooth taper shaped circumference wall 2*a*, so that the back side of the key top 2 can be concaved.

In addition, a position determining portion 2*b* extended radially in six directions by a predetermined length protrudes downward from the center portion of the concaved back surface of the key top 2. A position determining portion 8*a* of an elastic member 8, which will be discussed later, is positioned on the position determining portion 2*b* to determine, the position of the key top 2.

As shown in FIG. 7, a pair of first supporting walls 3, 3 protrude by a predetermined height and face each other in the upper and lower portions of a central line A to cross the position determining portion 2*b* on the concaved back surface of the key top 2. As illustrated in FIG. 6, angular groove shaped first and second slide supporting portions 3*a* and 3*b* are formed in a predetermined width B adjacent to each other with a partition wall 3*c* between them on the pair of first supporting walls 3, 3.

First shaft portions 5*e* of a first link member 5, which will be discussed later, are slidably supported by the first slide supporting portions 3*a*. In addition, first shaft portions 6*e* of a second link member 6, which will be discussed later, are slidably supported by the second slide supporting portions 3*b*.

In addition, chamfering portions 3*d* are formed in predetermined sizes in the facing corner portions of the pair of first supporting walls 3, 3.

Still referring to FIG. 6, a pair of second supporting walls 4, 4 protrudes in a substantially L shape by a predetermined height in order to face each other on the right and left sides of the central line A on the back surface of the key top 2. As shown in FIG. 6, third slide supporting portions 4*a* having a substantially L-shape are formed on the pair of second supporting walls 4, 4 and first shaft portions 7*e* of a third link member 7, which will be discussed later, are slidably supported by the third slide supporting portions 4*a*.

In addition, chamfering portions 4*b* are formed in predetermined sizes in the facing corner portions of the pair of first supporting walls 4, 4.

As shown in FIG. 8, the first link member 5, slidably supported by the first slide supporting portions 3*a*, 3*a* which face each other, has a substantially semicircular notch portion 5*b* in one end portion 5*a* of the upper side, and it also has one side portion 5*c* and the other side portion 5*d* which face each other in orthogonal direction to the right and left one end portions 5*a*, 5*a* with the notch portion 5*b* between them.

In addition, the first shaft portions 5*e*, 5*e* protrude to the outside from the one side portion 5*c* and the other side portion 5*d* of the one end portion 5*a*. As illustrated in FIG. 9, the thickness of the first link member 5 is greater than the diameter of the first shaft portions 5*e*, chamfering portions 5*f* are formed at the front ends of the first shaft portions 5*e* in predetermined sizes, and the front ends of the first shaft portions 5*e* are tapered.

Furthermore, the first link member 5 includes second shaft portions 5*h* protruding in the same directions as the first shaft portions 5*e* in the one side portion 5*c* and the other side portion 5*d* of the other end portion 5*g* on the lower side facing the one end portion 5*a*.

Furthermore, the second link member 6, slidably supported by the second slide supporting portions 3*b*, 3*b*, is installed on the side facing the first link member 5 with the elastic member 8, which will be discussed later, between them. As shown in FIGS. 10 and 11, the second link member 6 is symmetrical to the first link member 5 on the right and left side.

As shown in FIG. 10, the second link member 6 has a substantially semicircular notch portion 6*b* in one end portion 6*a* of the lower side, and it also has one side portion 6*c* and the other side portion 6*d* which face each other in orthogonal direction to the right and left one end portions 6*a*, 6*a* with the notch portion 6*b* between them.

The first shaft portions 6*e*, 6*e* protrude to the outside from the one side portion 6*c* and the other side portion 6*d* of the one end portion 6*a*. As illustrated in FIG. 11, the thickness of the second link member 6 is greater than the diameter of the first shaft portions 6*e*, chamfering portions 6*f* are formed at the front ends of the first shaft portions 6*e* in predetermined sizes, and the front ends of the first shaft portions 6*e* are tapered.

Furthermore, the second link member 6 includes second shaft portions 6*h* protruding in the same directions as the first shaft portions 6*e* in the one side portion 6*c* and the other side portion 6*d* of the other end portion 6*g* on the upper side facing the one end portion 6*a*.

As described above, as shown in FIG. 14, the elastic member 8, which will be discussed later, is installed on the side facing the semicircular notch portions 5*b* and 6*b* of the first and second link members 5 and 6. The first and second link members 5 and 6 are installed on the right and left sides which face each other with the elastic member 8 between them.

Furthermore, a third link member 7, slidably supported by the third slide supporting portions 4*a*, 4*a* of the key top 2, is installed in the outside upper portion of the first and second link members 5 and 6 as shown in FIG. 14.

Furthermore, first and second shaft portions 7*e* and 7*h* of the third link member 7 are installed in orthogonal direction of the protrusion direction of the first shaft portions 5*e* and 6*e* of the first and second link members 5 and 6.

As shown in FIG. 12, the third link member 7 has a substantially unshaped notch portion 7*b* in one end portion 7*a* on the lower side, and it also has one side portion 7*c* and the other side portion 7*d* which face each other in orthogonal direction to the right and left one end portions 7*a*, 7*a* with the notch portion 7*b* between them.

Further, the first shaft portions 7*e*, 7*e* protrude to the outside from the one side portion 7*c* and the other side portion 7*d* of the one end portion 7*a*. As illustrated in FIG. 13, the thickness of the first link member 7 is greater than the diameter of the first shaft portions 7*e*, chamfering portions 7*f* are formed at the front ends of the first shaft portions 7*e* in predetermined sizes, and the front ends of the first shaft portions 7*e* are tapered.

Furthermore, the third link member 7 includes second shaft portions 7*h* protruding in the same directions as the first shaft portions 7*e* in the one side portion 7*c* and the other side portion 7*d* on the other end portion 7*g* of the upper side facing the one end portion 7*a*. The other end portion 7*g* protrudes more to the outside than the second shaft portions 7*h*, and a slanted surface 7*j* having an angle of $\alpha$ is formed between the other end portion 7*g* and the second shaft portions 7*h*.

Furthermore, the elastic member 8 for determining the position of the position determining portion 2*b* of the key top 2 is adhered to a predetermined position of a film sheet 9, which will be discussed later, using an adhesive.

As shown in FIG. 2, the elastic member 8 applies elasticity to the key top 2 at a predetermined height C (initial position) from a base plate 10, which will be discussed later.

The elastic member 8 has a dome-shaped hollow inside. The position determining portion 2*b* of the key top 2 is position-determined on the top position determining portion 8*a*, so that the key top 2 can be position-determined on the elastic member 8.

Furthermore, a switch operating portion (not shown) is formed on a ceiling portion in the dome-shaped hollow inside. When the key top 2 is pressed to be lowered, the elastic member 8 is elastically transformed, and the switch operating portion operates a movable contact point formed on the film sheet 9, which will be discussed later, thereby converting a switch circuit.

As shown in FIG. 4, the base plate 10, on which the insulation film sheet 9 is mounted, is installed on the side facing the back surface of the key top 2.

The film sheet 9 is not shown. For example, the film sheet 9 includes a membrane switch formed by stacking three sheet members. A movable contact point is formed on a top sheet, an intermediate sheet is mounted, and a fixed contact point is formed on a bottom sheet facing the movable contact point.

When the elastic member 8 is elastically transformed by pressing the key top 2, the switch operating portion presses the top sheet to electrically connect the movable contact point to the fixed contact point, thereby converting the switch circuit.

Furthermore, the base plate 10, on which the film sheet 9 is mounted, is comprised of, for example, a metal plate such as aluminum. As illustrated in FIG. 14, first and second rotating supporting portions 10*a* and 10*b* for rotatably supporting the second shaft portions 5*h* and 6*h* of the first and second link members 5 and 6 are formed in a right angle shape and face each other.

In addition, third rotating supporting portions 10*c* for rotatably supporting the second shaft portions 7*h* of the third link member 7 are formed and face each other in orthogonal direction to the first and second rotating supporting portions 10*a* and 10*b*.

Furthermore, a plurality of drop holes 9*a* is formed on the film sheet 9. The first, second and third rotating supporting portions 10*a*, 10*b* and 10*c* of the base plate 10 are inserted into the drop holes 9*a* to stand straight.

Furthermore, the elastic member 8 can be adhered to the movable and fixed contact point position (not shown) of the film sheet 9 using an adhesive.

Furthermore, in the assembly process of the keyboard switch 1 according to the present invention as described above, when the film sheet 9 to which the elastic member 8 is previously adhered is put on the base plate 10, the first, second and third rotating supporting portions 10*a*, 10*b* and 10*c* are inserted into the drop holes 9*a* in the film sheet 9 to stand straight on the upper side, and the elastic member 8 is located in a predetermined position.

Next, the second shaft portions 5*h*, 5*h* of the first link member 5 are inserted into the pair of first rotating supporting portions 10*a*, and the second shaft portions 6*h*, 6*h* of the second link member 6 are inserted into the pair of second rotating supporting portions 10*b*. As a result, the second shaft portions 5*h* and 6*h* of the first and second link members 5 and 6 are supported by the first and second rotating supporting portions 10*a* and 10*b*.

In the first and second link members 5 and 6, one end portions 5*a* and 6*a*, which form the first shaft portions 5*e* and 6*e*, are rotatable from the second shaft portions 5*h* and 6*h*.

When the second shaft portions 7*h*, 7*h* of the third link member 7 are inserted into the pair of third rotating supporting portions 10*c*, one end portions 7*a*, which form the first shaft portions 7*e* in the third link member 7, are rotatable from the second shaft portions 7*h*.

The first, second and third link members 5, 6 and 7 for supporting the second shaft portions 5*h*, 6*h* and 7*h* by the first, second and third rotating supporting portions 10*a*, 10*b* and 10*c* rotate the first shaft portions 5*e*, 6*e* and 7*e*, and position them more closely to the elastic member 8 than the second shaft portions 5*h*, 6*h* and 7*h*, as shown in FIG. 14.

As a result, the first, second and third link members 5, 6 and 7 are positioned in the level state, so that the first shaft portions 5*e*, 6*e* and 7*e* can be located in predetermined positions of the base plate 10, respectively.

Next, in a state where the position determining portion 2*b* of the key top 2 is position-determined on the position determining portion 8*a* of the elastic member 8, when the key top 2 is pressed downward, the dome-shaped hollow inside of the elastic member 8 is elastically transformed, and the first, second and third slide supporting portions 3*a*, 3*b* and 4*a* of the key top 2 are positioned on the first shaft portions 5*e*, 6*e* and 7*e*, respectively.

When the key top 2 is pressed downward even more, the chamfering portions 3*d* and 4*b* formed on the first and second supporting walls 3 and 4 are lowered with the chamfering portions 5*f*, 6*f* and 7*f* of the first shaft portions 5*e*, 6*e* and 7*e*.

Accordingly, the notch portions 5*b*, 6*b* and 7*b* of the first, second and third link members 5, 6 and 7 are elastically transformed to be reduced in size, and the first shaft portions 5*e*, 6*e* and 7*e* are slidably inserted into the first, second and third slide supporting portions 3*a*, 3*b* and 4*a* of the key top 2.

When pressure applied to the key top 2 is removed, the key top 2 is lifted to the rising position of a predetermined height, namely the initial position, thereby finishing the assembly of the keyboard switch 1 of the present invention.

In the assembly process of the keyboard switch 1 according to present invention, the first shaft portions 5*e*, 6*e* and 7*e* of the first, second and third link members 5, 6 and 7 are automatically position-determined by merely mounting the second shaft portions 5*h*, 6*h* and 7*h* of the first, second and third link members 5, 6 and 7 on the base plate 10. As a result, the key top 2 can be mounted on the first, second and third link members 5, 6 and 7 by pressing it, which considerably simplifies the assembly process.

Different from the conventional keyboard switch, the keyboard switch of the present invention does not require a base frame that includes pedestals for determining the positions of the link members.

The operation of the keyboard switch 1 of the present invention as described above will now be explained. When the key top 2 located in a lifting position having a predetermined height is pressed to be lowered, a contact point operating portion (not shown) in the hollow portion of the elastic member 8 presses the movable contact point of the film sheet 9, and thus the movable contact point contacts the fixed contact point for electric connection.

As a result, the switch circuit is converted to input a signal to a personal computer, etc.

After the switch circuit is converted, if pressure applied to the key top 2 is removed, the key top 2 is lifted to the predetermined lifting position from the base plate 10 due to the elastic force of the elastic member 8 returning to the initial state.

When the key top 2 returns to the lifting position C (initial position), the movement of the first shaft portions 5*e* and 6*e* of the first and second link members 5 and 6 is restricted in the first and second slide supporting portions 3*a* and 3*b* of the key top 2. As a result, the key top 2 is prevented from being lifted over the predetermined lifting position.

At the same time, the other end portion 7*g* of the third link member 7 contacts the base plate 10, on which the film sheet 9 is mounted, to restrict the movement of the third link member 7.

Accordingly, when the keyboard switch 1 of the present invention has a problem, the key top 2 can be easily detached from the first, second and third link members 5, 6 and 7.

In the aforementioned embodiment of the present invention, the first, second and third link members 5, 6 and 7 have been exemplified. However, it is also possible to use only the first and second link members 5 and 6. That is, a plurality of link members is preferably used to freely lift or lower the key top 2 to/from the base plate 10.

As described above, according to the present invention, the plurality of link members of the keyboard switch has their one end portions slidably supported by the slide supporting portions formed on the key top, and their other end portions rotatably supported by the rotating supporting portions formed on the base plate. Therefore, the positions of the link members are automatically determined before mounting the key top, which simplifies the assembly process.

In addition, the keyboard switch does not require the base frame which includes the pedestals for determining the positions of the link members, thereby reducing the number of the components.

Furthermore, the plurality of link members slidably support the first shaft portions by the slide supporting portions formed on the key top and rotatably support the second shaft portions by the rotating supporting portions formed on the base plate, so that the key top can be freely lifted or lowered to/from the base plate.

The first and second link members are installed to face each other with the elastic member between them, and the third link member is positioned outside the first and second shaft portions, and has its first and second shaft portions installed in orthogonal direction to the protrusion directions of the first and second shaft portions of the first and second link members. Accordingly, the key top can be easily lifted or lowered in the level state by the first, second and third link members.

Furthermore, the elastic member applies elasticity to the center portion of the key top. The first shaft portions of the link members supported by the slide supporting portions of the key top are aligned more closely to the elastic member than the second shaft portions thereof, so they can accurately apply elasticity of the elastic member to the key top to smoothly lift or lower the key top.

When the key top reaches the predetermined lifting position, the movement of the first shaft portions of the first and second link members is restricted in the first and second slide supporting portions to prevent the key top from being lifted over the predetermined lifting position. As a result, the operation capability of the key top is improved.

The other end portion of the third link member protrudes more to the outside than the second shaft portions. When the key top is lifted to the lifting position, the other end portion thereof contacts the base plate via the film sheet to prevent the key top from being lifted over the lifting position. Accordingly, the key top can be easily detached.

Furthermore, the front ends of the first shaft portions of the link members are tapered, so that the key top can be easily mounted thereon in the assembly process.

What is claimed is:

1. A keyboard switch comprising a key top, a base plate installed on a side facing the key top, an insulation film sheet mounted thereon, an elastic member for applying elasticity to the key top at a predetermined height from the base plate, a plurality of link members for supporting the key top to be freely lifted to or lowered from the base plate, and a contact point portion opened or closed by the lifting or lowering operation of the key top, wherein each of the plurality of link members has a first end portion and a second end portion facing each other, the plurality of link members being installed so as not to cross each other with the first end portions slidably supported by slide supporting portions formed on the key top and the second end portions rotatably supported by rotating supporting portions formed on the base plate, and wherein each of the plurality of link members has a first side portion and a second side portion orthogonal to the first end portion and the second end portion so that the first side portion and the second side portion face each other, first shaft portions protrude to the outside from the first side portion and the second side portion of the first end portion, second shaft portions protrude in the same directions as the first shaft portions from the first side portion and the second side portion of the second end portion, the first shaft portions are slidably supported by the slide supporting portions of the key top, and the second shaft portions are rotatably supported by the rotating supporting portions of the base plate.

2. The keyboard switch according to claim 1, wherein the plurality of link members comprises first, second and third link members, the first and second link members are installed to face each other with the elastic member between the first and second link members, and the third link member is positioned outside the first and second shaft portions with the first and second shaft portions installed orthogonal to protrusion directions of the first and second shaft portions of the first and second link members.

3. The keyboard switch according to claim 1, wherein the elastic member applies elasticity to a center portion of the key top, and the first shaft portions of the link members supported by the slide supporting portions of the key top are closer to the elastic member than the second shaft portions thereof.

4. The keyboard switch according to claim 1, wherein three sets of slide supporting portions are formed to face each other, the first and second slide supporting portions for supporting the first shaft portions of the first and second link members are adjacent to first supporting walls formed on the key top, and when the key top reaches a predetermined lifting position, the movement of the first shaft portions of the first and second link members is restricted in the first and second slide supporting portions to prevent the key top from being lifted over the predetermined lifting position.

5. The keyboard switch according to claim 1, wherein the third slide supporting portions for supporting the first shaft portions of the third link member are installed on second supporting walls formed on the key top, the third link member has an other end portion more protruded to the outside than the second shaft portions, and when the key top reaches the lifting position, the other end portion contacts the base plate on which the film sheet is mounted, to prevent the key top from being lifted over the lifting position.

6. The keyboard switch according to claim 1, wherein front end portions of each of the first shaft portions of the link members are tapered.

* * * * *